US009105434B2

(12) United States Patent
Schill, Jr.

(10) Patent No.: US 9,105,434 B2
(45) Date of Patent: Aug. 11, 2015

(54) HIGH CURRENT, HIGH ENERGY BEAM FOCUSING ELEMENT

(75) Inventor: Robert A. Schill, Jr., Henderson, NV (US)

(73) Assignee: The Board Of Regents Of The Nevada System Of Higher Education On Behalf Of The University Of Nevada, Las Vegas, Las Vegas, NV (US)

( * ) Notice: Subject to any disclaimer, the term of this patent is extended or adjusted under 35 U.S.C. 154(b) by 854 days.

(21) Appl. No.: 13/100,427

(22) Filed: May 4, 2011

(65) Prior Publication Data

US 2012/0280609 A1 Nov. 8, 2012

(51) Int. Cl.
*H01J 9/02* (2006.01)
*H01J 25/00* (2006.01)

(52) U.S. Cl.
CPC ..... *H01J 25/00* (2013.01)

(58) Field of Classification Search
CPC ..... H01J 25/00
USPC ..... 313/310
See application file for complete search history.

(56) References Cited

U.S. PATENT DOCUMENTS

| | | | | |
|---|---|---|---|---|
| 1,767,437 | A | 6/1930 | De Boer et al. | |
| 3,947,716 | A | 3/1976 | Fraser, Jr. et al. | |
| 3,970,887 | A | 7/1976 | Smith et al. | |
| 4,303,930 | A | 12/1981 | Van Gorkom et al. | |
| 4,307,507 | A | 12/1981 | Gray et al. | |
| 4,331,936 | A * | 5/1982 | Schlesinger et al. | 372/2 |
| 4,370,797 | A | 2/1983 | Van Gorkom et al. | |
| 4,685,996 | A | 8/1987 | Busta et al. | |
| 4,721,878 | A * | 1/1988 | Hagiwara et al. | 313/362.1 |
| 4,855,636 | A | 8/1989 | Busta et al. | |
| 4,857,799 | A | 8/1989 | Spindt et al. | |
| 4,964,946 | A | 10/1990 | Gray et al. | |
| 5,600,200 | A | 2/1997 | Kumar et al. | |
| 5,973,447 | A * | 10/1999 | Mahoney et al. | 313/359.1 |
| 2005/0195393 | A1 * | 9/2005 | Karanassios | 356/316 |
| 2009/0260481 | A1 * | 10/2009 | Boulos et al. | 75/10.19 |
| 2010/0090581 | A1 * | 4/2010 | Terui et al. | 313/336 |
| 2011/0085852 | A1 * | 4/2011 | Ferrara | 403/350 |
| 2012/0269326 | A1 * | 10/2012 | Adler et al. | 378/138 |
| 2012/0280609 | A1 * | 11/2012 | Schill, Jr. | 313/310 |

* cited by examiner

*Primary Examiner* — Nimeshkumar Patel
*Assistant Examiner* — Jacob R Stern
(74) *Attorney, Agent, or Firm* — Ballard Spahr LLP

(57) ABSTRACT

Methods and systems for electron emission are disclosed. An example system can comprise a cup-rod-needle assembly that can collect a source of electrons and allow internal space charge build-up and generation of an internal self-electric field build-up. The system can provide self-emission at a predetermined location of the needle in the system. An example system can comprise a cup-rod-needle assembly, an annular dielectric insulator as a plug, a source of electrons to provide electrons into a cup, and a beam drift tube.

20 Claims, 2 Drawing Sheets

HIGH CURRENT, HIGH ENERGY BEAM FOCUSING ELEMENT

BACKGROUND OF THE INVENTION

1. Field of the Invention

The present invention relates to the field of capture, controlling, managing, transporting and emission of currents while minimizing stray current loss. The field of the present invention further relates to the field of electron capture and subsequent emission of the charge as a field or current.

2. Background of the Art

Field emission is a phenomenon which occurs when an electric field proximate the surface of an emission material narrows a width of a potential barrier existing at the surface of the emission material. This allows a quantum tunneling effect to occur, whereby electrons cross through the potential barrier and are emitted from the material. This is as opposed to thermionic emission, whereby thermal energy within an emission material is sufficient to eject electrons from the material. Thermionic emission is a classical phenomenon, whereas field emission is a quantum mechanical phenomenon.

The field strength required to initiate field emission of electrons from the surface of a particular material depends upon that material's effective "work function." Many materials have a positive work function and thus require a relatively intense electric field to bring about field emission. Some materials do, in fact, have a low work function, or even a negative electron affinity, and thus do not require intense fields for emission to occur. Such materials may be deposited as a thin film onto a conductor, resulting in a cathode with a relatively low threshold voltage required to produce electron emissions.

In prior art devices, it was desirable to enhance field emission of electrons by providing for a cathode geometry which focused electron emission at a single, relatively sharp point at a tip of a conical cathode (called a micro-tip cathode). These micro-tip cathodes, in conjunction with extraction grids proximate the cathodes, have been in use for years in field emission displays.

For example, U.S. Pat. No. 4,857,799 (Spindt et al.) is directed to a matrix-addressed flat panel display using field emission cathodes. The cathodes are incorporated into the display backing structure, and energize corresponding cathodoluminescent areas on a face plate. The face plate is spaced 40 microns from the cathode arrangement in the preferred embodiment, and a vacuum is provided in the space between the plate and cathodes. Spacers in the form of legs interspersed among the pixels maintain the spacing, and electrical connections for the bases of the cathodes are diffused sections through the backing structure. Spindt et al. employ a plurality of micro-tip field emission cathodes in a matrix arrangement, the tips of the cathodes aligned with apertures in an extraction grid over the cathodes. With the addition of an anode over the extraction grid, the display described as a triode (three terminal) display.

Unfortunately, micro-tips employ a structure which is difficult to manufacture, since the micro-tips have fine geometries. Unless the micro-tips have a consistent geometry throughout the display, variations in emission from tip to tip will occur, resulting in unevenness in illumination of the display. Furthermore, since manufacturing tolerances are relatively tight, such micro-tip displays are expensive to make.

For years, others have directed substantial effort toward solving the problem of creating cathodes which can be mass manufactured to tight tolerances, allowing them to perform with accuracy and precision. Another object of some of these prior art inventions was that they made use of emission materials having a relatively low effective work function so as to minimize extraction field strength.

One such effort is U.S. Pat. No. 3,947,716 (Fraser), directed to a field emission tip on which a metal adsorbent has been selectively deposited. In a vacuum, a clean field emission tip is subjected to heating pulses in the presence of an electrostatic field to create thermal field build up of a selected plane. Emission patterns from this selected plane are observed, and the process of heating the tip within the electrostatic field is repeated until emission is observed from the desired plane. The adsorbent is then evaporated onto the tip. The tip constructed by this process is selectively faceted with the emitting planar surface having a reduced work function and the non-emitting planar surface as having an increased work function. A metal adsorbent deposited on the tip so prepared results in a field emitter tip having substantially improved emission characteristics. Since emission occurs from a relatively sharp tip, emission is still somewhat inconsistent from one cathode to another. Such disadvantages become intolerable when many cathodes are employed in great numbers such as in a flat panel display for a computer.

As is evident in the above-described cathode structure, an important attribute of good cathode design is to minimize the work function of the material constituting the cathode. In fact, some substances such as alkali metals and elemental carbon in the form of diamond crystals display a low effective work function. Many inventions have been directed to finding suitable geometries for cathodes employing negative electron affinity substances as a coating for the cathode. For instance, U.S. Pat. No. 3,970,887 (Smith et al.) is directed to a microminiature field emission electron source and method of manufacturing the same wherein a single crystal semiconductor substrate is processed in accordance with known integrated microelectronic circuit techniques to produce a plurality of integral, single crystal semiconductor raised field emitter tips at desired field emission cathode sites on the surface of a substrate in a manner such that the field emitters tips are integral with the single crystal semiconductor substrate. An insulating layer and overlying conductive layer may be formed in the order named over the semiconductor substrate and provided with openings at the field emission locations to form micro-anode structures for the field emitter tip. By initially appropriately doping the semiconductor substrate to provide opposite conductivity-type regions at each of the field emission locations and appropriately forming the conductive layer, electrical isolation between the several field emission locations can be obtained. Smith et al. call for a sharply-tipped cathode.

U.S. Pat. No. 4,307,507 (Gray et al.) is directed to a method of manufacturing a field-emitter array cathode structure in which a substrate of single crystal material is selectively masked such that the unmasked areas define islands on the underlying substrate. The single crystal material under the unmasked areas is orientation-dependent etched to form an array of holes whose sides intersect at a crystal graphically sharp point.

U.S. Pat. No. 4,685,996 (Busta et al.) is also directed to a method of making a field emitter and includes an anisotropically etched single crystal silicon substrate to form at least one funnel-shaped protrusion on the substrate. The method of manufacturing disclosed in Busta et al. provides for a sharp-tipped cathode. Sharp-tipped cathodes are further described in U.S. Pat. No. 4,855,636 (Busta et al.).

Yet another sharp-tipped emission cathode is disclosed in U.S. Pat. No. 4,964,946 (Gray et al.), disclosing a process for fabricating soft-aligned field emitter arrays using a soft-leveling planarization technique, e.g. a spin-on process.

Even though many of these disclosures employ low effective work-function materials to advantage, sharp-tipped cathodes have fundamental problems when employed in a flat panel graphic display environment, as briefly mentioned above. First, they are relatively expensive to manufacture. Second, they are hard to manufacture with great consistency. That is, electron emission from sharp-tipped cathodes occurs at the tip. Therefore, the tip must be manufactured with extreme accuracy such that, in a matrix of adjacent cathodes, some cathodes do not emit electrons more efficiently than others, thereby creating an uneven visual display in other words, the manufacturing of cathodes must be made more reliable so as to minimize the problem of inconsistencies in brightness in the display along its surface.

Electron-emitting bodies may be a thermionic cathode, for example, in a vacuum tube, but may especially be a semiconductor cathode; in the latter case, various kinds of semiconductor cathodes may be used, such as NEA cathodes, field emitters and more particularly reverse junction cathodes, as described U.S. Pat. Nos. 4,303,930 and 4,370,797. Such vacuum tubes are suitable to be used as camera tubes or display tubes, but may also be used in apparatus for Auger spectroscopy, electron microscopy and electron lithography. These devices may also be provided with a photocathode, incident radiation leading to an electron current which leaves the photocathode. Such photocathodes are used in photocells, camera tubes, image converters and photomultiplier tubes. Another application of a device according to the invention resides in so-called thermionic converters, in which thermal radiation is converted into an electron current. The devices may further include to a reservoir for such an arrangement. Such a device is known from U.S. Pat. No. 1,767,437. In this case, cesium is deposited in a discharge tube by heating a dissolved mixture of cesium chloride and barium oxide so that the cesium chloride is reduced by the released barium to metallic cesium, which spreads over the interior of the discharge tube. In an embodiment shown in the patent Specification, the mixture to be heated is provided in a side tubule attached to the vacuum tube, which afterwards is sealed off from this tube. In this arrangement, a quantity of cesium is consequently introduced only once into the vacuum space. If use is made of a semiconductor cathode, this cesium will cover the emitting surface as a mono-atomic layer, after which reduction of the quantity of cesium on the emitting surface cannot or can substantially not be compensated. Such a reduction of cesium or another material reducing the electron work function at the surface is due inter alia to desorption and migration under the influence of electric fields and gives rise to degradation of the emission. The ultimate efficiency of, for example, a reverse biased junction cathode thus remains limited to 20 to 40% of the optimum value.

U.S. Pat. No. 5,600,200 (Kumar) describes a wire mesh cathode, such as a field emission cathode for use in flat panel displays comprises a layer of conductive material and a layer of amorphic diamond film, functioning as a low effective work-function material, deposited over the conductive material to form emission sites. The emission sites each contain at least two sub-regions having differing electron affinities. The cathode may be used to form a computer screen or a fluorescent light source.

SUMMARY OF THE INVENTION

A system (cup-rod-plug-needle assembly) that collects a source of electrons allowing for internal space charge build-up and hence internal self-electric field build-up that results in self-emission at a predetermined location (needle) in the system using at least:

- a conducting medium at one end of the structure denoted as the needle (geometry may not be needle like) having a work function of less than Y eV (typical absolute values of 3 to 4 eV) acting like a cathode allowing for field emission;
- a conducting rod between the needle and cup to transport collected electrons with work function greater than X eV (typical absolute values 5.5 to 6.35 eV);
- an annular dielectric insulator, plug, with rod passing through acts as an electrical and mechanical barrier for mounting and as a barrier for pressure differentials;
- a source of electrons to provide electrons into the cup portion of the assembly acting like an anode;
- a beam drift tube to house and enable electron transport to the cup-rod assembly, the surface of the cup and rod have a work function greater than X eV;
- the plug with rod passing through seals and terminates the beam drift tube at one end;
- the cup-rod-needle assembly may be isolated electrically; and
- wherein $X-Y \geq 2.5$.

DETAILED DESCRIPTION OF THE INVENTION

Figure 1:
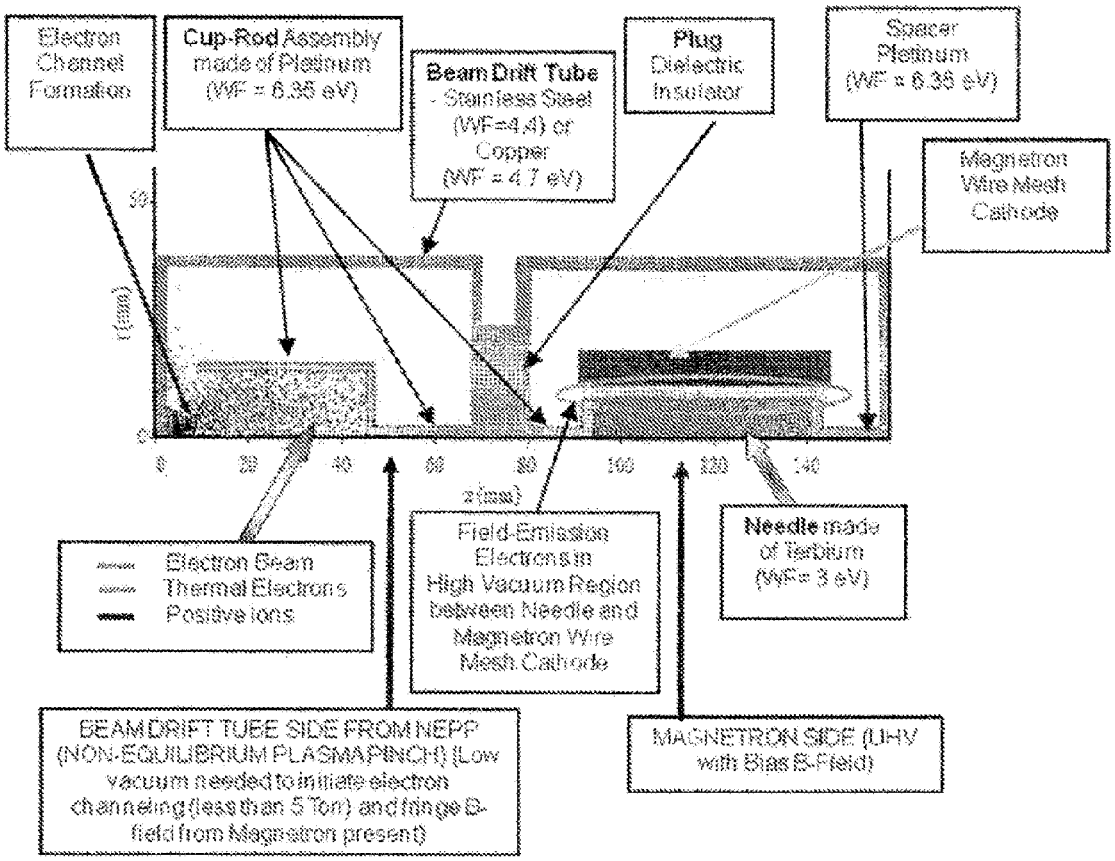
FIG. 1 shows a side cutaway view of a schematic drawing of a device according to the present technology.
Figure 2:
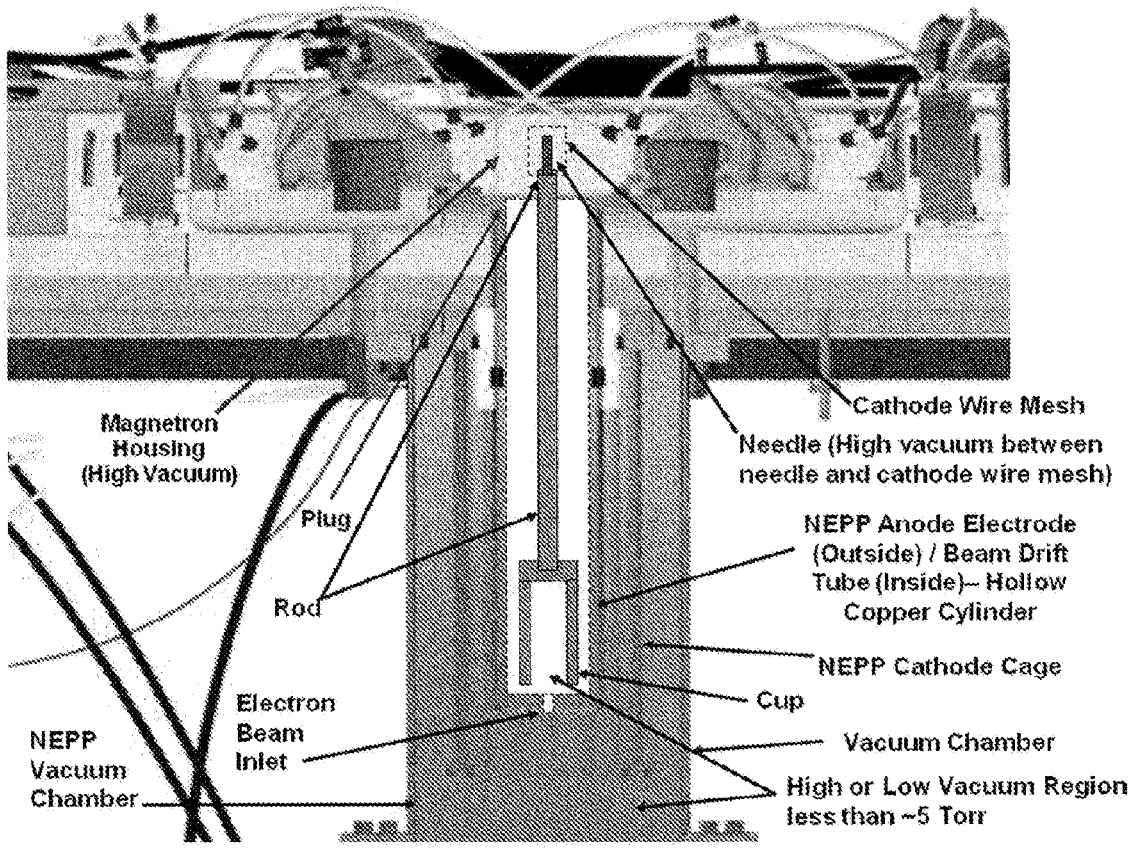
FIG. 2 shows an alternative side cutaway view of a schematic drawing of a device according to the present technology.

Capturing, controlling and managing, transporting, and emitting large currents with minimal stray current loss is of importance in devices generating large number of charge. The charges of interest are electrons. Further, transporting these charges from one environment to another is typically difficult to impossible with practical external magnetic and/or electric lenses due to the large space charge effects. We have developed a means that uses the quantum properties of material to retain and emit the captured charge and the conduction properties to transport the charge. All metallic mediums have what is denoted as work function. The work function is the amount of energy that a charge must have in order to be statistically emitted by the metal medium. The conductivity of the metal allows for the flow of charge internal to the metal.

Solid uncoated material combinations as well as material coatings or material laminates were sought to capture, secure, and transfer charge from a large electron production source such as the non-equilibrium plasma pinch (NEPP) to the insides of the magnetron without unsealing the magnetron, with minimal emission losses, and with minimal dielectric charging. Especially of interest, laminates would provide a differential work function in material cross section. With the view that is harder for materials with higher work functions to emit, we anticipate that we can control the emission location using geometry, field configuration, and material properties. It is desired that the cup-rod-plug assembly in the NEPP anode captures and contains electrons without emission (without internal space charge effects leading to self-field emission). One desires the inside of the cup to have minimal secondary electron emission properties. Once the electrons are collected by the metallic medium, space charge effects, internal to the conducting medium, forces the electrons to the electrode's outer most surface. This occurs on time scales roughly on the order of a relaxation time of the metallic medium. Internal field enhancement results internal to the metal medium. This leads to internal (self or, equivalently, space charge) field emission of electrons from the metal. Designing the cup out of a high work function material tends to inhibit space charge field emission as verified with MAGIC PIC™ codes and a one dimensional PSpice code. It is anticipated that a coating or laminate should have the same effect as long as the high work function coating or laminate is on the outer side of the cup. In all cases, if a gas environment exists in the drift tube, electron channeling and hence focusing will aid in directing the high energy electrons to the cup. The ions that are generated due to electron channeling are too heavy to move in the short time. Although electron channeling may help, typically space charge effects of the high energy electrons to be captured overwhelm the focusing power of the channel.

Additionally, the following considerations should be taken for better understanding of the invention. One significant operational consideration that assists in the performance of the technology is a "large" differential work function. The numbers we prefer are based on the materials that we could find that best matched our application needs. Our simulations have shown very good results when the materials have a larger differential work function (about a difference of at least 8 or 9, preferably at least 9 and more preferably at least 10). If the state of the art changes and new materials are developed, then a better more versatile device can be built of differing materials, but having the same functional characteristics described herein. In this case, the constraints on the source may be relaxed. Note also that the pressure limitation provided below is a consequence of many factors.

It is possible to use the same general technique described herein to guide the collected electron bunch directly to ground without emission. Because the electron bunch is confined in the material medium due to the work function property of the material, we will be able to bring the electron bunch closer to the walls of structure thereby optimizing electromagnetic coupling and hence microwave generation, minimize size, and minimize pulse shortening. Material heating would be addressed (by thermal insulation) in such a construction. In this case, the plug and needle component may not be needed depending on the device.

The techniques we are working on for microwave generation schemes can be extended or applied to other fields (environmental and medical) in an air environment (limited by Paschen effects).

Capturing, controlling and managing, transporting, and emitting large currents with minimal stray current loss is of importance in devices generating large numbers of charge. The charges of interest are electrons. Further, transporting these charges from one environment to another is typically difficult to impossible. We have developed a means that uses the quantum properties of materials to retain and emit the captured charge and the conduction properties to transport the charge. All metallic mediums have what is denoted as a work function. The work function is the amount of energy that a charge must have in order to be statistically emitted by the metal medium. The conductivity of the metal allows for the flow of charge internal to the metal.

Currently, the solid material of choice is platinum (work function ~6.35 eV) (for the cup and rod) and terbium (work function ~3.0 eV) for the needle. FIG. 1 provides a picture of the invention in the NEPP with magnetron.

The invention goes beyond magnetron application. Containing, maintaining, and managing the flow of charge in a material body allows for the charge to be brought closer to electromagnetic generating slow wave structures. The coupling between the slow wave structure and the beam is enhance as the distance of separation between the structures is decreased. Further, because the beam is mainly contained in the metal medium due to work function properties, there is a smaller probability that spurious charge will maybe resulting from material out-gassing or desorption from interfering with the current flow in the invention. In this particular case, emission from a needle tip is not required. Instead, the rod is bent and attached to ground allowing for a path of least resistance for the collected burst of charge. In such a case, the current in the rod removes the need for bending and focusing magnets.

An alternative description of the systems of the present technology may include the following. A system collects a source of electrons allowing for internal space charge build-up and hence internal self-electric field build-up that results in self-emission at a predetermined location (needle) in the system using components of:

a conducting medium at one end of the structure denoted as the needle (geometry may not be needle like) having a work function of less than Y eV (typical absolute values 3 to 4 eV) acting like a cathode allowing for field emission;

a conducting rod between the needle and cup to transport collected electrons with work function greater than X eV (typical absolute values 5.5 to 6.35 eV);

an annular dielectric insulator, plug, with rod passing through acts as an electrical and mechanical barrier for mounting and as a barrier for pressure differentials (the dielectric insulator is usually maintained under vacuum condition, such as less than 5 Tor, less than 4 Torr, less than 3 Torr, and the like);

a source of electrons to provide electrons into the cup portion of the assembly acting like an anode;

a beam drift tube to house and enable electron transport to the cup-rod assembly, the surface of the cup and rod have a work function greater than X eV;

the plug with rod passing through seals and terminates the beam drift tube at one end;

the cup-rod-needle assembly may be isolated electrically;

the beam drift tube supporting a vacuum of less than 5 Torr; and wherein $X-Y \geq 2.5$.

The source of electrons may be an electron beam and X−Y may be ≥4.0; $X-Y \geq 6.0$; $X-Y \geq 8.0$; or $X-Y \geq 10.0$. The needle may have a work function of less than 3.5 eV. The beam drift tube may be composed of stainless steel or copper. The cup-rod assembly may contain platinum surfaces. The beam drift tube assembly may support a range of vacuum, including a vacuum of less than 5 Torr. In one preferred embodiment, the needle comprises terbium.

Also described is a method for generating an electromagnetic field in the systems described herein. Electrons are injected into a gas environment (when suitable) near the anode to initiate electron channeling aiding the anode capture of electrons, through the beam drift tube via a rod, past the dielectric insulator to the needle in the cathode.

Another alternative system described herein collects a source of electrons allowing for internal space charge build-up and hence internal self-electric field build-up that results in self-emission at a predetermined location (needle) in the system using components of:

a conducting medium at one end of the structure denoted as the needle (geometry may not be needle like) having a work function of less than 4.0 eV acting like a cathode allowing for field emission;

needle inserted in a wire mesh cathode in a cathode structure;

a dielectric insulator between the needle and a wire mesh cathode;

a conducting rod between the needle and cup to transport collected electrons with work function less than 6.35 eV;

an annular dielectric insulator, plug, with rod passing through acts as an electrical and mechanical barrier for mounting and as a barrier for pressure differentials;

a source of electrons to provide electrons into the cup portion of the assembly acting like an anode;

a beam drift tube non-equilibrium plasma pinch to house and enable electron transport to the cup-rod assembly by way of electron channeling, the surface of the cup and rod have a work function less than 6.35 eV;

the plug with rod passing through seals and terminates the beam drift tube at one end;

the cup-rod-needle assembly may be isolated electrically;

the beam drift tube supporting a vacuum of less than 5 Torr;

The invention goes beyond electromagnetic generation applications. Potentially it is possible to capture electrons from any electron generating source such as an electron accelerator using the invention and transport these electrons from a vacuum environment to an air environment by way of a rod and needle for field emission processes. Applications may extend to medical, environmental, and biological fields where electrons or high currents are desired.

What is claimed:

1. A cup-rod-plug-needle system that collects a source of electrons, allows internal space charge build-up and generation of an internal self-electric field build-up that then provides self-emission at a predetermined location of the needle in the system, the system comprising:

a conducting medium at one end of a structure as the needle having a work function of less than Y eV, which needle acts as a cathode allowing field emission based on internal space charge build-up and generation of an internal self-electric field;

a cup-rod assembly comprising a conducting rod between the needle and a cup to transport collected electrons, the conducting rod having a work function greater than X eV, the needle and the cup-rod assembly forming a cup-rod-needle assembly;

an annular dielectric insulator as a plug, with the conducting rod passing through the plug, the insulator providing an electrical and mechanical barrier for mounting and a barrier for pressure differentials;

a source of electrons to provide electrons into the cup, the cup acting as an anode;

a beam drift tube that houses and enables electron transport to the cup-rod assembly, a surface of the cup and the conducting rod of the cup-rod assembly having a work function greater than X eV;

the plug with rod passing through seals and terminate at one end of the beam drift tube; and wherein $X-Y \geq 2.5$.

2. The system of claim 1 wherein the source of electrons comprises an electron beam and wherein $X-Y \geq 10.0$ and the cup-rod-needle assembly is isolated electrically.

3. The system of claim 1 wherein the needle has a work function of less than 3.5 eV and wherein $X-Y \geq 8.0$.

4. The system of claim 3 wherein the beam drift tube is composed of stainless steel or copper.

5. The system of claim 1 wherein the anode and the cathode comprise platinum surfaces.

6. The system of claim 1 wherein the beam drift tube assembly supports a vacuum of less than 5.0 Torr.

7. The system of claim 1 wherein the needle comprises terbium.

8. A method for generating an electromagnetic field in the system of claim 1 comprising: injecting electrons into a gas environment within the system, initiating and sustaining an electron channel to the anode aiding anode capture of electrons through the beam drift tube via the rod, past the dielectric insulator and to the needle acting as a cathode.

9. A system that collects a source of electrons allows for internal space charge build-up and internal self-electric field build-up that results in self-emission at a needle at a predetermined location in the system comprising:

a needle as a conducting medium at one end of the system having a work function of less than 4.0 eV acting like a cathode configured for field emission based on internal space charge build-up and generation of an internal self-electric field;

the needle being within a wire mesh cathode in an isolated cathode structure under high vacuum;

a dielectric insulator in the cathode structure between the needle and the wire mesh cathode;

a conducting rod between the needle and a cup to transport collected electrons with the conducting rod having a work function less than 6.35 eV, the conducting rod, the needle, and the cup forming a cup-rod-needle assembly;

an annular dielectric insulator plug, with the conducting rod passing through the annular dielectric insulator plug acting as an electrical and mechanical barrier and as a barrier for pressure differentials;

a source of electrons to provide electrons into the cup and the cup acting as an anode;

a non-equilibrium plasma pinch to generate the source of electrons;

a beam drift tube non-equilibrium plasma pinch to house and enable electron transport to an assembly of the cup and the conducting rod by way of electron channeling, a surface of the cup and the conducting rod having a work function less than 6.35 eV;

the annular dielectric insulator plug and the conducting rod passing through seals and terminating the beam drift tube; and the cup-rod-needle assembly are isolated electrically.

10. The system of claim 9 wherein the source of electrons comprises an electron beam at one end.

11. The system of claim 9 wherein the needle has a work function of less than 3.5 eV.

12. The system of claim 9 wherein the beam drift tube is composed of stainless steel or copper.

13. The system of claim 9 wherein the anode and the cathode comprise platinum surfaces.

14. The system of claim 9 wherein the beam drift tube assembly supports a vacuum of less than 5 Torr.

15. The system of claim 9 wherein the needle comprises terbium.

16. A method for generating an electromagnetic field in the system of claim 9 wherein electrons are injected into a gas environment initiating and sustaining an electron channel to the anode, allowing anode capture of electrons through the beam drift tube via a rod, past the dielectric insulator to the needle in the cathode.

17. A system that collects a source of electrons and allows internal space charge build-up and internal self-electric field build-up that results in self-emission at a predetermined location of a needle cathodic structure in the system comprising:

a cup-rod assembly anode contained in a structure having a work function of and a needle cathodic structure acting as a secondary cathode;

a needle of the needle cathodic structure inserted in a wire mesh cathode in the cathodic structure;

a dielectric insulator between the needle and a wire mesh cathode;

a source of electrons to provide electrons into the cup-rod assembly in the anode;

a beam drift tube non-equilibrium plasma pinch housing and enabling electron transport to the cup-rod assembly by electron channeling, a surface of the cup-rod assembly having a work function greater than X eV;

the needle acting as a secondary cathode within a primary wire mesh cathode structure positioned above an interior surface of the cup-rod assembly and centrally located within and vacuum insulated from the wire mesh cathode structure in the primary cathode structure, the needle configured for field emission based on internal space charge build-up and generation of an internal self-electric field;

the needle having a work function of less than Y eV; and wherein $X-Y \geq 2.5$.

18. The system of claim 17 wherein $X-Y \geq 4.0$.

19. The system of claim 17 wherein $X-Y \geq 6.0$.

20. The system of claim 17 wherein $X-Y \geq 8.0$.

* * * * *